United States Patent [19]

Shallenberg et al.

[11] 4,270,238

[45] Jun. 2, 1981

[54] CLEANING TOOL

[75] Inventors: Robert L. Shallenberg, Wheaton; Roland A. Blomgren, Glen Ellyn, both of Ill.

[73] Assignee: Service Master Industries, Inc., Downers Grove, Ill.

[21] Appl. No.: 58,485

[22] Filed: Jul. 18, 1979

Related U.S. Application Data

[63] Continuation-in-part of Ser. No. 929,355, Jul. 31, 1978, abandoned, which is a continuation of Ser. No. 841,379, Oct. 12, 1977, abandoned, which is a continuation of Ser. No. 647,795, Jan. 9, 1976, abandoned.

[51] Int. Cl.[3] ..... A47L 11/38

[52] U.S. Cl. ..... 15/321; 15/322

[58] Field of Search ..... 15/321, 322, 353, 398, 15/401, 418

[56] References Cited

U.S. PATENT DOCUMENTS

| | | | |
|---|---|---|---|
| 1,093,532 | 4/1914 | Cavalier | 15/322 X |
| 2,292,435 | 8/1942 | Crites | 15/322 X |
| 2,531,370 | 11/1950 | Thompson | 15/401 X |
| 2,822,565 | 2/1958 | Dow | 15/418 X |
| 2,867,835 | 1/1959 | Brown et al. | 15/322 X |
| 2,941,233 | 6/1960 | Prong | 15/398 |
| 3,591,889 | 7/1971 | Wisner | 15/322 X |
| 3,902,219 | 9/1975 | Jones | 15/321 X |

FOREIGN PATENT DOCUMENTS

| | | | |
|---|---|---|---|
| 584806 | 10/1959 | Canada | 15/321 |
| 1577672 | 6/1969 | France | 15/322 |

*Primary Examiner*—Christopher K. Moore

*Attorney, Agent, or Firm*—Allegretti, Newitt, Witcoff & McAndrews

[57] ABSTRACT

The improved cleaning tool disclosed herein is particularly designed for cleaning walls and ceilings. The tool includes a novel block assembly that is mounted on an end of a wand adapted to be held and manipulated by the person doing the cleaning and that includes one surface adapted to be disposed adjacent to the wall or ceiling to be cleaned during the cleaning operation. Two continous rows of channel bristles are mounted on the one surface of the block assembly and extend across the one surface, in a direction transverse to the normal, back and forth path of motion of the block assembly while in usage. The block assembly includes a plurality of nozzles that are designed to wet the rows of channel bristles with cleaning fluid so that the cleaning fluid will flow to the distal ends of the bristles and then be applied, as a thin film, to the wall or ceiling to be cleaned. Vacuum suction slots are disposed between the rows of channel bristles. A uniform flow of air is drawn into the vacuum suction slots, at a relatively high velocity, and this air flow extracts or removes the cleaning fluid applied to the wall or ceiling to be cleaned from the wall or ceiling almost immediately after its application onto the wall or ceiling.

10 Claims, 9 Drawing Figures

CLEANING TOOL

BACKGROUND AND SUMMARY OF THE INVENTION

This is a continuation-in-part of application Ser. No. 929,355, filed July 31, 1978, now abandoned, which, in turn, was a continuation of application Ser. No. 841,379, filed Oct. 12, 1977, now abandoned, which, in turn, was a continuation of application Ser. No. 647,795, filed Jan. 9, 1976, now abandoned.

The present invention relates to an improved cleaning tool, and more particularly, to an improved tool adapted for cleaning the walls and ceiling of a room without leaving unsightly streaks and the like on the cleaned walls or ceiling and for use by a person standing on the floor of the room. The improved cleaning tool is particularly useful in disaster restoration work, i.e. in preparing surfaces for repainting after soiling due to smoke and soot or dirt deposited by flooding, and is able to satisfactorily clean such surface for repainting where heretofore such surfaces ordinarily have had to be scraped and replastered prior to being repainted.

The cleaning of walls and ceilings has long been recognized as a time consuming, laborious job, even when done by professional maintenance service personnel. Today, as in the past, walls and ceilings are generally cleaned by utilizing a sponge, towel, rag or the like to manually apply a cleaning fluid, e.g. a detergent and water solution, to the wall or ceiling to be cleaned. The cleaning fluid is usually in a bucket that must be carried about by the person doing the cleaning, and the rag or sponge must be repeatedly cleaned and re-wetted by dipping it into the bucket. Usually a ladder or similar device must be used to enable the person doing the cleaning to reach the upper portions of the wall and the ceiling. The usage of a ladder means that the person doing the cleaning must frequently climb up and down the ladder in order to re-wet his rag or sponge, or alternatively, that he must balance or otherwise support the bucket of cleaning fluid on the ladder. In the latter instance, the bucket must be carried up and down the ladder when the ladder is periodically moved around the room. Often times it is necessary to apply a rinse fluid to the walls and the ceiling in order to remove the cleaning fluid and dirt from the walls and ceiling. This rinse fluid is usually applied by a rag or sponge in a manner similar to the application of the cleaning fluid.

Aside from being a difficult, frequently back-breaking job, this above rags-and-bucket method of cleaning walls and ceilings has other disadvantages. Unless the person doing the cleaning is extremely careful, cleaning fluid or rinse water may trickle or run down and over a dry, adjacent portion of the wall or ceiling, and this will leave unsightly streaking which mars the appearance of the walls or ceiling even after they have been otherwise cleaned. In addition, the rags-and-bucket method of cleaning allows the dirt and bacteria to be carried from one area to another unless the cleaning fluid is changed after the rag has been dipped only a few times. Such inadvertent spreading of dirt and bacteria may lead to serious sanitation and health problems, particularly in hospitals and other health care facilities. Furthermore when sponges and rags are used to clean rough surfaces, e.g. a swirl ceiling, the sponges and rags are subjected to considerable wear and tear and must be replaced frequently.

It is a primary object of our present invention to provide an improved cleaning tool that substantially reduces the time and effort and the amount of cleaning fluid required to clean the walls and ceiling of a room as compared with cleaning with the rag-and-bucket method. Our improved cleaning tool permits facile, superior cleaning of the walls and ceiling in a room. The tool permits rapid moistening of an entire surface without allowing the liquid to trickle down the dry surface, thus preventing unsightly streaking on the walls. By utilizing a continuous stream of fresh cleaning solution, it eliminates, for all practical purposes, the possibility that dirt and bacteria from one room will be spread to another room when a number of rooms are being cleaned. Our improved cleaning tool is designed to be operated by a person standing on the floor of the room and does not require the person to climb a ladder or to handle buckets of cleaning or rinse fluid during the cleaning operation.

More specifically, it is an object of our present invention to provide an improved cleaning tool which includes a novel block assembly mounted on an end of a wand that is adapted to be held and manipulated by the person doing the cleaning. The wand is of sufficient length so as to enable the block assembly to be disposed adjacent to even the most remote portions of the walls or ceiling to be cleaned without requiring the person to stand on a ladder or similar device. The block assembly includes one surface which is positioned adjacent to the wall or the ceiling to be cleaned during the cleaning operation and which includes front and rear edges that extend transversely to the normal, back and forth movement imparted to the block assembly during usage. Two continuous rows of channel bristles are mounted on the one surface of the block assembly adjacent to its front and rear edges so that the distal ends of the bristles project outwardly from the one surface of the block assembly and contact the wall or ceiling to be cleaned during the cleaning operation.

A plurality of nozzles are mounted on the one surface of the block assembly between the front and rear edges of the assembly and the adjacent rows of bristles and are used to uniformly wet all of the bristles in the rows of bristles with a cleaning fluid, such as a low-foaming detergent and water solution. The flow of cleaning fluid through the nozzles is controlled so that the cleaning fluid just flows out to the distal ends of the bristles, but does not run or drip off of the distal ends of the bristles. The bristles and nozzles are arranged so that the cleaning fluid will flow up the bristles by capillary action for cleaning ceilings, and the movement of the bristles and their deflection, due to their contact with the surface to be cleaned, produces a massaging action by the bristles which causes a substantially uniform application of the cleaning fluid to the surface as well as a desirable cleaning action. In other words, the cleaning fluid on the distal ends of the bristles is applied, as a thin, substantially uniform film, to the wall or ceiling to be cleaned by the normal back and forth motion of the block assembly which is imparted to the block assembly by moving the wand in a similar manner.

A pair of longitudinal slots are disposed in the one surface of the block assembly and are positioned equidistant about the central, transverse axis or centerline of the block assembly and midway between the continuous rows of bristles. The inner tapered ends of the slots communicate, via the interior of the wand, with a source of vacuum which causes air to be drawn into the slots during the cleaning operation. The shape of the slots is designed so that a relatively high velocity flow of air, as compared with the velocity of the air flow in the remainder of the tool, will be drawn generally uniformly into and through the slots. This air flow causes the cleaning fluid, together with the dirt suspended therein, to be stripped from the surface of the wall or ceiling almost immediately after the cleaning fluid has been applied. The substantially instantaneous extraction or removal of the cleaning fluid prevents the evaporation or drying of the cleaning fluid on the surface and also eliminates the cause of unsightly streaking by preventing cleaning fluid from trickling or running down and across a dry portion of the wall. The tool permits wetting the surface rapidly so that if there is any tendency to drip, the fluid flow will be over a wet surface.

To facilitate use of the improved cleaning tool of our present invention, the other, lower end of the wand includes a valve for controlling the flow of cleaning fluid through a nozzle and a valve for controlling the flow of air through the wand. The bristles are the only part of the cleaning tool which is subjected to any substantial wear, and the rows of bristles may be selectively removed to permit the replacement of worn bristles.

A spray nozzle may be mounted on the block assembly for spraying cleaning fluid directly onto the wall or ceiling to be cleaned prior to the use of our improved cleaning tool as described above. Such a spray nozzle has particular utility when our improved cleaning tool is utilized to clean a room which has suffered smoke damage.

These and other objects and advantages of our present invention become apparent in the following description of the preferred embodiments of our invention, described in connection with the accompanying drawings.

DESCRIPTION OF THE DRAWNGS

Figure 1:
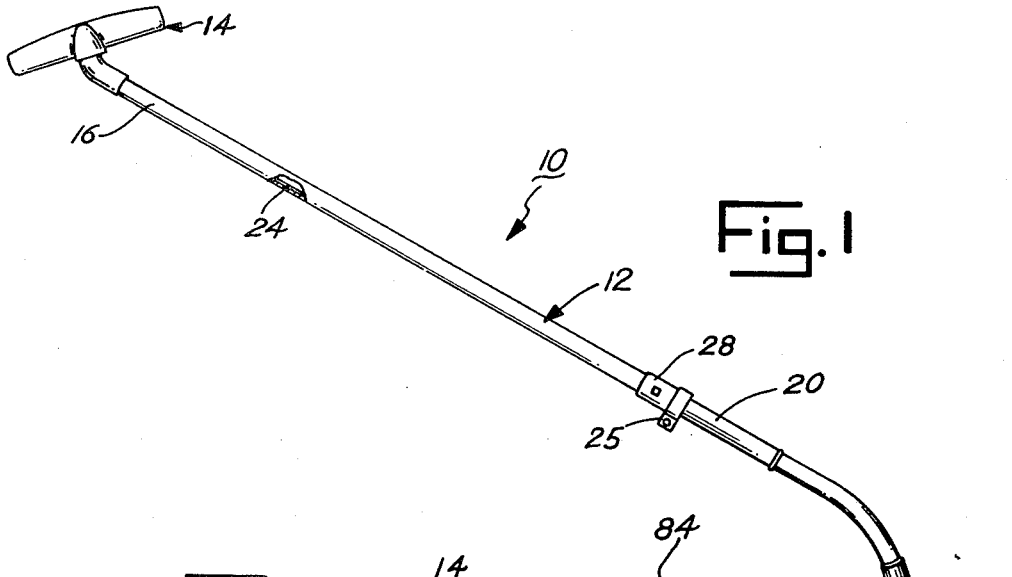
FIG. 1 is a perspective view of a cleaning tool embodying the principles of our present invention.
Figure 2:
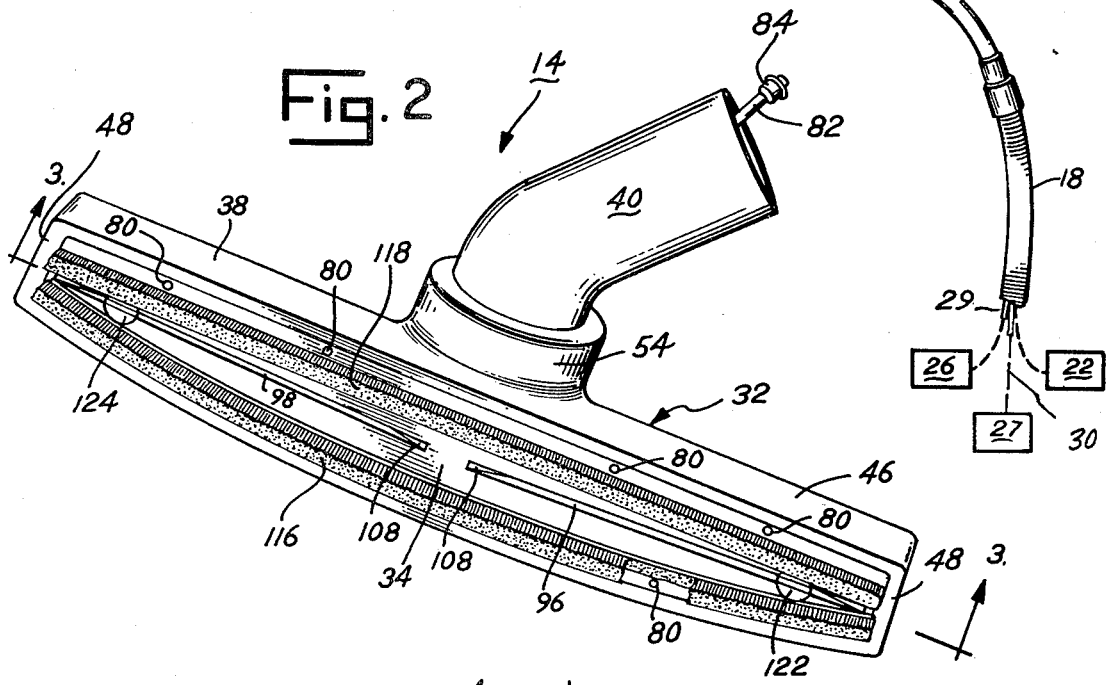
FIG. 2 is an enlarged, perspective view of the block assembly used with the improved cleaning tool shown in FIG. 1.

Throughout the various figures of the drawings, the same reference numerals will be used to designate the same parts or components. Moreover, when the term "right", "left", "side", "right end", "left end", "front", "rear", "front edge", "rear edge", "upper" and "lower" are used herein, it is to be understood that these terms have reference to the structure shown in the drawings as it would appear to a person viewing the drawings and are utilized solely for convenience in describing the preferred embodiment of our invention.

DESCRIPTION OF THE PREFERRED EMBODIMENT

Referring now to FIG. 1, the preferred embodiment of our improved cleaning tool is shown generally at 10. This tool 10 includes a rigid, tubular wand 12 which has a block assembly 14 mounted on its upper end 16 and which has a flexible conduit 18 attached to its lower end 20. The wand 12 may be telescopically lengthened or shortened and includes a conventional twist lock mechanism, not shown, to prevent undesired changes in length during usage. The length of the wand 12 is selected so that when a person is holding the wand 12, adjacent to its lower end 20, he may comfortably position the block assembly 14 adjacent to the highest and remotest portions of the wall or ceiling to be cleaned without the need to stand on a ladder or similar device.

The conduit 18 is also connected with a conventional source of vacuum, shown diagrammatically at 22, which produces sufficient suction in the interior of the wand 12 and conduit 18 to cause air to flow through the wand 12 and conduit 18. A relatively small diameter tube 24 is positioned within the wand 12. One end of the tube 24 is disposed adjacent to the upper end 16 of the wand 12, the other end of the tube 24 is connected with a conventional, four position valve, shown generally at 25. The valve 25 communicates with a conventional source of cleaning fluid, such a low-foaming detergent and water solution, shown diagrammatically at 26, and a conventional source of rinse solution, such as clean water or a bactericide, shown diagrammatically at 27, by means of relatively small diameter tubes 29 and 31, respectively, which are positioned, at least in part, within the conduit 18. The valve 25 is mounted on the lower end 20 of the wand 12 and is designed to be operated by a person holding the lower end of the wand 12 so that he may regulate the flow of cleaning or rinse solution. More specifically, when the valve 25 is moved to a first position, the fluid supply source 26 may be utilized to pump cleaning solution through the tubes 29 and 24; when the valve 25 is moved to a second position, the fluid supply source 27 may be utilized to pump rinse solution through the tubes 30 and 24; and when the valve 25 is moved to a third position, flow through the valve 25 will be blocked.

A conventional air valve 28 is mounted on the lower end 20 of the wand 12, adjacent to the valve 25, and is utilized to regulate the flow of air passing through the wand and conduit 18. Like the valve 25, the valve 28 is designed so that it may be operated by a person while he is holding the lower end 20 of the wand 12.

As best shown in FIGS. 2–8, the block assembly 14 includes an enclosure assembly 32, a block 34 and a cover plate 36. The enclosure assembly 32 comprises an enclosure body 38 and a tubular member 40. One end of the member 40 telescopically receives the upper end 16 of the wand 12 so that the member 40, and thus the entire block assembly 14, is securely mounted on the upper end 16. The other end of the member 40 is connected with the enclosure body 38 by means of a conventional swivel-joint which is shown generally at 42 in FIG. 4 and which permits the enclosure body 38 to swivel about and with respect to the member 40, and thus the upper end 16 of the wand 12.

The enclosure body 38 comprises a curved front wall 44, a generally straight rear wall 46, two side walls 48 and a top wall 50. The walls 44–50 define a recess 52 which is designed to receive the block 34 and cover plate 36. The central part of the top wall 50 includes an enlarged domed portion 54 which defines a chamber 56 that communicates with the recess 52 and with the interior of the tubular member 40, and thus the interior of the wand 12.

The block 34 and cover plate 36 are normally positioned within the recess 52 during usage of the tool 10. The block and cover plate are retained in the recess 52 by cooperation between transversely directed shoulders 58 formed on the lower, distal ends of the side walls 48 and notches formed on the block 34. A plurality of spaced ribs 60 depend from the lower surface of the top wall 50 and are adapted to abut the cover plate 36.

The block 34 includes a curved front wall 62, a generally straight rear wall 64 and side walls 66. The walls 62–66 have generally the same overall shape as the corresponding front, rear and side walls 44–48, respectively, of the enclosure body 38. The block 34 and plate 36 are dimensioned so that they are adapted to tightly and snuggly fit within the recess 52 defined by the walls 44–48 when the block 34 and plate 36 are properly positioned within the recess 52, i.e., when the shoulders 58 engage the notches on the block 34. During normal usage of the tool 10, the wand 12 is manipulated so that the block assembly 14 moves back and forth across the wall or ceiling to be cleaned in a direction generally perpendicular to the planes of the front walls 44 and 62 and the rear walls 46 and 64 of the enclosure body 38 and the block 32.

The block 34 has an upper surface 68 and lower surface 70. The upper surface 68 has the same configuration and outer dimensions as the cover plate 36, and the cover plate 36 is normally secured, for example by an adhesive, to the top surface of the block 34 so that the plate 36 completely overlies and covers the upper surface 68.

Figure 3:
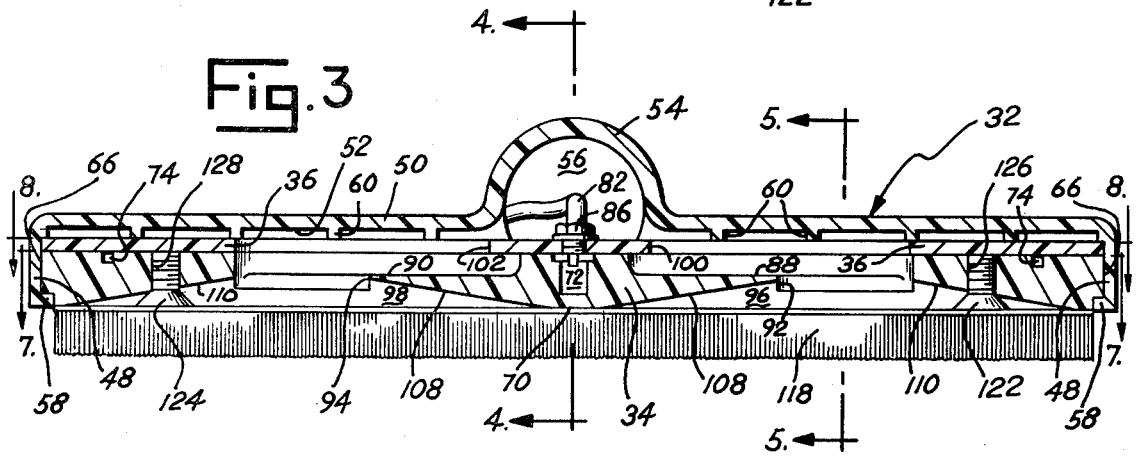
FIG. 3 is a cross-sectional view taken along the line 3—3 of FIG. 2.
Figure 4:
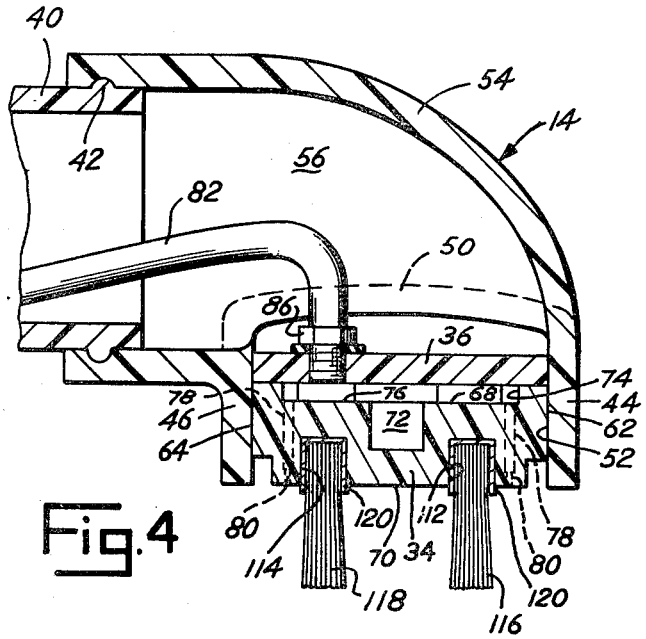
FIG. 4 is a cross-sectional view taken along the line 4—4 in FIG. 3.
Figure 5:
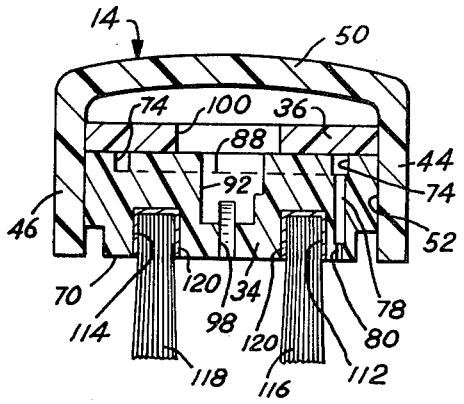
FIG. 5 is a cross-sectional view taken along the line 5—5 in FIG. 3.
Figure 6:
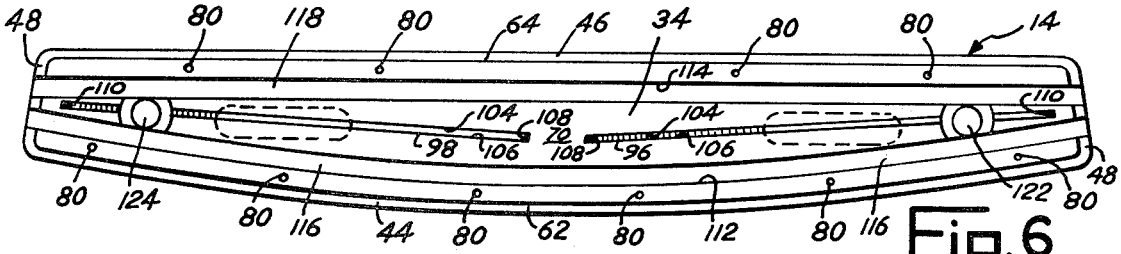
FIG. 6 is a plan view of the surface of the block assembly shown in FIG. 3.
Figure 7:
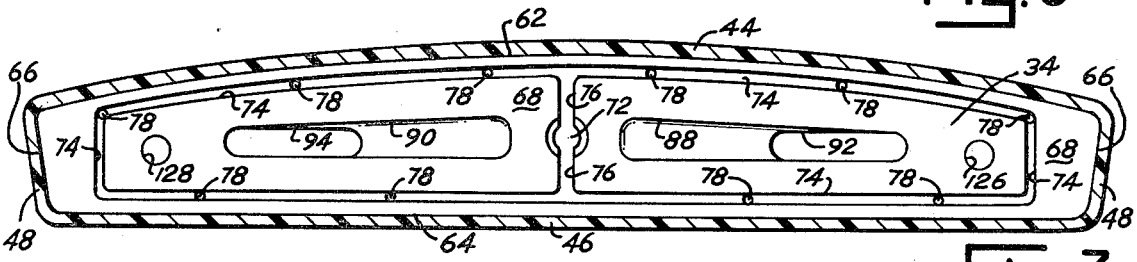
FIG. 7 is a partial cross-sectional view taken along the line 7—7 in FIG. 3.
Figure 8:
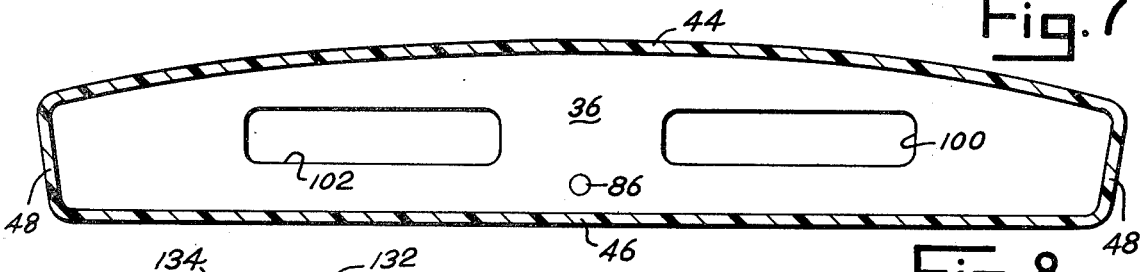
FIG. 8 is a partial cross-sectional view taken along the line 8—8 in FIG. 3.

As best seen in FIGS. 3, 4 and 7, the upper surface 68 of the block 34 includes a centrally disposed bore 72 and a groove 74 that extends along and generally parallel to the front, rear and side walls 62–66 of the block. A transfer groove 76 is formed in the upper surface 68 of the block 34 so that its axis is generally coaxial with the transverse axis or centerline of the block 34, and interconnects the central bore 72 with the groove 74 adjacent the front and rear walls 62 and 64. A plurality of relatively small diameter bores 78 are formed in the block 34 at regularly spaced intervals along the portions of the groove 74 that parallel the front and rear walls 62 and 64 of the block. These bores 78 extend from the upper surface 68 through the block 34 to the lower surface 70. The ends of the bores 78 adjacent to the lower surface 70 include nozzles 80 which may be a separate part or may be a reduced diameter portion of the bores 78. As best shown in FIG. 6, six nozzles 80 are disposed at evenly spaced intervals along and adjacent to the curved front wall 62 and four nozzles 80 are disposed along and adjacent to the rear wall 64 so that the transverse planes which include these rear wall nozzles 80 are evenly spaced between the transverse planes which include the front wall nozzles 80.

When the cover plate 36 is secured to and overlies the upper surface 68 of the block 34, as shown in FIGS. 3 and 4, the central bore 72, the grooves 74 and 76, the bores 78 and the nozzles 80 define a closed fluid distribution system which is designed to permit fluid to flow uniformly to and out of the nozzles 80. Fluid is introduced into this fluid distribution system, i.e., into the central bore 72, the grooves 74 and 76, the bores 78 and the nozzles 80, through a tube 82 which is disposed within the chamber 56 and the tubular member 40 and which has one end 84 adapted to be connected to the distal end of the tube 24 by means of a fitting 84 shown in FIG. 2. The other end of the tube 82 is connected to the cover plate 36 by means of a fitting 86 to that fluid flowing through the tubes 24 and 82 is introduced into the central bore 72 and transfer groove 76.

A pair of longitudinal grooves 88 and 90 are also formed in the upper surface 68 of the block 34. The longitudinal axes of these grooves 88 and 90 are generally parallel to the longitudinal axis of the block 34, and the grooves are equi-spaced from and about the central transverse axis of the block 34. The ends of the grooves 88 and 90 remote from the central transverse axis of the block 34 communicate with apertures 92 and 94, respectively. The apertures 92 and 94, in turn, communicate with generally longitudinal slots 96 and 98, respectively, formed in the lower surface 70. The grooves 88 and 90, the apertures 90 and 92 and the slots 96 and 98 permit air to flow from the lower surface 70 of the block 34, through the block, to the upper surface 68. The cover plate 36 includes a pair of generally rectangular apertures 100 and 102 that are aligned with and overlie the grooves 88 and 90 when the plate 36 is secured to the upper surface of the block 34. The apertures 100 and 102 permit air flowing through the grooves 88 and 90 to pass into the chamber 56 defined by the domed portion 54 of the top wall 50 of the enclosure assembly 32.

The cover plate 36 is contructed so that when it is secured to the upper surface 68 of the block 34, it prevents any fluid in the central bore 72 or in the grooves 74 and 76 from flowing or otherwise leaking into the grooves 88 and 90. Similarly the cover plate 36 prevents any air in the grooves 88 or 90 from flowing or otherwise leaking into the central bore 72 and the grooves 74 and 76.

The generally longitudinal slots 96 and 98 are equi-spaced about the central transverse axis of the block 34 and extend, from end to end, from adjacent to the central transverse axis of the block 34 to adjacent to the side walls 66 of the block. Each of the slots 96 and 98 includes side walls 104 and 106 and end walls 108 and 110. The side walls 104 of each of the slots 96 and 98 are generally parallel to each other and are spaced relatively closely to one another. The end walls 108 and 110 of each of the slots 96 and 98 are tapered inwardly so that the distance between the end walls 108 and 110, adjacent to the lower surface 70 is greater than the distance between the end walls at a point adjacent to the apertures 92 and 94. The design of the grooves 88 and 90, the apertures 92 and 94 and the slots 96 and 98 assures that when the vacuum source 22 is being operated, air will be drawin into and through the slots 96 and 98 and into the apertures 92 and 94 at a relatively high velocity, as compared with the velocity of the air flowing downstream of the slots. As seen in FIG. 3, the highest velocity air flow is achieved as the air passes through the apertures 92 and 94 because these apertures provide the greatest restriction to air flow in the tool 10. The air will continue to flow from the apertures 92 and 94 through the grooves 88 and 90, the apertures 100 and 102, the chamber 56, the interior of the tubular member 12 and the conduit 18.

Two longitudinal grooves 112 and 114 are also formed in the lower surface 70 of the block 34 and extend from one side wall 66 of the block 34 to the other. The groove 112 is curved in a manner similar to the curve of the front wall 62 of the block 34 and is disposed between the nozzles 80, adjacent to the front wall 62, and the longitudinal axis of the block. The groove 114 is relatively straight and is disposed between the nozzles 80, adjacent to the rear wall 64, and the longitudinal axis of the block.

Two continuous rows 116 and 118 of channel bristles are positioned within the grooves 112 and 114, respectively. The row 116 is curved in a manner similar to that of the groove 112 while the row 118 is straight. The rows 116 and 118 have a length which is equal to the length of the groove 112 and 114, respectively, so that when the rows of bristles are disposed in the grooves, the bristles extend from one side wall 48 of the enclosure body 32 to the other. The ends of the first and second rows 116 and 118 are disposed adjacent to but spaced from each other at the side walls 66 of the block 34.

Each of the rows of bristles includes a channel 120 which has a U-shaped configuration, in cross-section, and which conforms in size and shape to the grooves 112 and 114. The rows of bristles are secured to the block 34 by a pair of flat head screws 122 and 124 which are adapted to be screwed in the threaded apertures 126 and 128 formed in the block 34. More specifically, the heads of the screws 122 and 124 are of sufficient size that they overlie the adjacent edge of the channels 120 of the rows 116 and 118 and this retains the rows of bristles within the grooves 112 and 114.

It is important to note that the rows of bristles 116 and 118 constitute continuous rows of bristles and do not constitute a series of tufted clumps of bristles which have spaces between the adjacent clumps of bristles. In other words, the rows of bristles 116 and 118 should not have any gaps or spaces therein. Furthermore, the bristles in the rows of bristles 116 and 118 should be long enough to be flexible but not "floppy". The distal ends of the bristles in the rows of bristles 116 and 118 project outwardly from the lower surface 70 of the block 34 and are the only part of the block assembly 14 which physically contacts the wall or ceiling to be cleaned during the cleaning operation. During such contact, the distal ends of the bristles are generally always deflected and moving, in a sort of a massaging type action, and this assists in achieving the desired substantially even distribution of fluid along the rows of bristles. As a consequence of this contact, the bristles in the rows of bristles 116 and 118 tend to wear. The rows of bristles can, however, be easily replaced by the simple expedient of loosening the screws 122 and 124 and sliding the rows lengthwise out of the grooves 112 and 114. New rows of bristles can thereafter be inserted in the grooves 112 and 114 and the screws 122 and 124 re-tightened. Although natural bristles can be used for the rows of bristles 116 and 118, artificial bristles such as those made from nylon have been found to have better wear characteristics.

Figure 9:
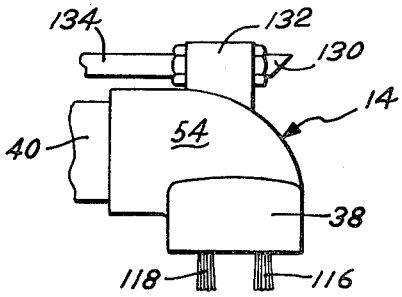
FIG. 9 is an elevational view of the block assembly shown in FIGS. 2–8 with a spray nozzle mounted thereon.

As shown in FIG. 9, a conventional spray nozzle, shown generally at 132, may be mounted on the domed portion 54 of the top wall 50 of the enclosure body 38. The spray nozzle 130 may be connected, via tubing 134, the valve 25 and the tube 29, with the cleaning fluid supply 26. More specifically, when it is desired to spray cleaning fluid through the spray nozzle 132, the valve 25 may be moved to a fourth position wherein the fluid supply 26 is placed in communication with the nozzle 132. When the valve 25 is positioned in its other positions, the valve 25 prevents the flow of cleaning fluid from the fluid supply 26 and the tubing 134. The spray nozzle 132 has particular utility for initially wetting a severely smoke soiled wall to allow more chemical action time prior to the cleaning of the wall or ceiling in the regular manner by the tool 10.

Tools substantially structurally and functionally identical to the tool 10 described hereinabove have been constructed and have been found to provide excellent cleaning action. In one such tool, all the components of the block assembly 14, except for the bristles in the rows of bristles 116 and 118 and the screws 122 and 124, were molded from LEXAN plastic. The head 34 and an overall, longitudinal length, from side wall to side wall, of 9.750 inches and the maximum width of the head 34, as measured adjacent to the central transverse axis of the block 34, was 1.469 inches. The two slots 96 and 98 were each 4.375 inches in length, were located 0.250 inches from the transverse axis of the block 34, and had a width, i.e. the distance between the side walls 104 and 106, of 0.062 inches. The distance between the end walls 108 and 110 of the slots adjacent the lower surface 70 was approximately 4.375 inches, while the distance between the end walls 108 and 110 adjacent to the apertures 92 and 94 was approximately 1.250 inches. The depth of the slots, i.e. as measured from apertures 92 and 94 to the lower surface 70 was about 0.250 inches.

The diameter of the bores 78 was approximately 0.062 inches while the diameter of the nozzles 80 was approximately 0.028 inches. The flow through the nozzles 80 should be between one to two ounces per minute per nozzle and preferably between one and one-half ounces per minutes per nozzle. Ten nozzles were used. The centerline of the nozzles 80 was 0.172 inches from the adjacent front or rear wall 62 or 64 of the block 34. The grooves 112 and 114 were 0.230 inches wide and were located 0.234 inches from the adjacent front or rear wall 62 or 64.

When the tool 10 is used in a cleaning operation, the person operating the tool 10 manipulates the wand 12 so that the lower surface 70 of the block 34 is positioned adjacent to the portion of the wall or ceiling to be cleaned. The fluid supply 26 is actuated and the flow of fluid through the tube 24 is controlled or regulated by adjustment valve 25. More specifically, the valve 25 is adjusted so that a relatively low volume of fluid flows through the tube 24, the tube 82, and into the central bore 72 and the grooves 74 and 76. The fluid then flows into the bores 78 and out through the nozzles 80 onto the bristles in the rows of bristles 116 and 118. The flow of fluid is regulated so that the amount of flow through the nozzles 80 generally, uniformly wets all the bristles in the rows of bristles and flows from the nozzles 80 to the distal ends of the bristles. When the tool 10 is used to clean a ceiling, the fluid will flow up, via capillary action, so that the fluid is present at the distal ends of the bristles. It is important that the flow of fluid through the nozzles 80 is not large enough so that the fluid is forced to flow past or drop off the distal ends of the bristles. Back and forth movement of the block assembly 14, in a direction substantially perpendicular to the front walls 44 and 62 and the rear walls 46 and 64 of the enclosure body 38 and the block 34, results in a thin film of fluid being applied to the wall or ceiling to be cleaned. As noted above, the distal ends of the bristles are generally deflected and tend to move, in a massaging type action, during the application, and this tends to loosen the dirt, etc. on the wall or ceiling being cleaned.

After the vacuum source 22 has been actuated, the flow of air through the wand 12 is regulated by adjusting the valve 28, so that a relatively high velocity of air is drawn or sucked through the slots 96 and 98. It has been found that the construction and arrangement of the slots 96 and 98, as described hereinabove, causes air to be drawn or sucked into the slots generally, uniformly from the front, rear and sides of the tool 10 when the tool is positioned adjacent to a wall or ceiling to be cleaned, with the bristles in contact. With the wall or ceiling, although as will be recognized by those working in this art, absolute uniformity of flow probably cannot and will not be achieved in actual practice. This generally uniform flow of air extracts or removes the fluid, together with any entrained or suspended dirt, etc., almost immediately after the fluid is applied to the wall or ceiling. In other words, the fluid is applied to the wall or ceiling and is then substantially instantaneously extracted or removed, together with the dirt, etc. entrained or suspended therein, from the wall or ceiling. The relatively high velocity of the air flow assures that substantially all of the fluid, and the entrained or suspended dirt, etc., will be extracted or "lifted" from the wall or ceiling.

This air, with the entrained dirt, etc. then proceeds to flow into and through the slots 96 and 98, through the apertures 92 and 94, the grooves 88 and 90, the apertures 100 and 102, and the chamber 56, the interior of the tubular member 40, the interior of the wand 12, and the interior of conduit 18. In this regard, the velocity of the air flowing into and through the slots 96 and 98 increases as the air approaches the apertures 92 and 94, and it reaches its maximum velocity as it passes through the apertures 92 and 94. This increase in velocity in the slots 96 and 98 helps to minimize the risk that any of the entrained fluid in the air will condense into droplets on the walls of the slots 96 and 98 and then run back onto the surface being cleaned. Once the air flow passes through the apertures 92 and 94 and the grooves 88 and 90, the fluid, even if it condenses into droplets, is unlikely to be capable of running back onto the surface being cleaned, and hence the velocity of the air flow need not be, and is not, as high downstream of the slots as it is in the slots. As a result of the almost immediate extraction of the fluid applied to the wall, the fluid does not have an opportunity to trickle or run down over any dry portion of the wall. Consequently, the tool 10 can be used without leaving any unsightly streaks on the walls and ceiling.

In view of the foregoing, it should be apparent to those having skill in this art that our improved cleaning tool 10 represents a significant improvement over the prior devices used to clean walls and ceilings. Not only does the use of our tool 10 significantly reduce the time required for cleaning a wall or ceiling, but in addition, the usage of our tool eliminates the possibility that unsightly streaks will be left on the wall after cleaning and eliminates the possibility that dirt, etc. from one room will contaminate other rooms being cleaned. Furthermore, usage of tools constructed and operated in accordance with the principles of our invention has demonstrated that the tool can perform a much better job of cleaning, in about sixty percent of the time and using about one-third of the cleaning solution that the prior rag-and-bucket method of cleaning.

It should also be obvious to those having skill in this art that our invention may be embodied in forms other than the specific form disclosed hereinabove without departing from the spirit or central characteristics thereof. Therefore, the preferred embodiment described herein is thus to be considered in all respects as illustrative and not restrictive, the scope of our invention being indicated by the appended claims, rather than by the foregoing description, and all changes which come within the meaning and range of equivalency of the claims are intended to be embraced therein.

We claim:

1. An improved cleaning tool for the facile cleaning of walls and ceilings, the improved cleaning tool comprising:

(A) means for supplying a cleaning fluid under pressure;

(B) a block assembly which has one surface adapted to be positioned adjacent to the surface of a wall or ceiling to be cleaned and which has a front edge, a rear edge and side edges, the block assembly being adapted to be moved back and forth across the surface of the wall or ceiling to be cleaned in a direction generally perpendicular to the front and rear edges of the block assembly and including:

(i) a first continuous row of bristles that extends generally along the front edge of the block assembly from one side edge of the block assembly to the other side edge and between the front edge and the longitudinal axis of the block assembly and that have their distal ends projecting generally perpendicularly from the one surface of the block assembly toward the surface of the wall or ceiling to be cleaned;

(ii) a second continuous row of bristles that extends generally along the rear edge of the block assembly from one side edge of the block assembly to the other side edge and between the rear edge and the longitudinal axis of the block assembly and that have their distal ends projecting generally perpendicularly from the one surface of the block assembly toward the surface of the wall or ceiling to be cleaned; and (iii) a plurality of spaced nozzles that are disposed adjacent to the first and second rows of bristles and between the first row of bristles and the front edge of the block assembly and between the second row of bristles and the rear edge of the block assembly;

(C) means for connecting the nozzles in the block assembly with the means for supplying cleaning fluid so that cleaning fluid can flow to and through the nozzles;

(D) means for controlling the flow of cleaning fluid through the nozzles to substantially uniformly wet the bristles in the first and second rows of bristles so that a thin film of cleaning fluid is applied to the surface of the wall or ceiling to be cleaned, as the block assembly is moved back and forth across the surface, by the distal ends of the bristles;

(E) slot means formed in the block assembly and having first and second ends, having a central axis disposed substantially parallel to the longitudinal axis of the block assembly and having generally parallel, relatively closely spaced side walls that are generally parallel to the central axis and having tapered end walls, with the second end of the slot means having a crossectional area less than one crossectional area of the first end of the slot means and with the first end opening to the one surface of the block assembly between the first and second rows of bristles;

(F) means for providing a source of vacuum capable of sucking air into and through the block assembly when the distal ends of the bristles are in contact with the surface to be cleaned; and (G) means for connecting the second end of the slot means with the vacuum source means so that air sucked into the block assembly causes the extraction of the cleaning fluid from said surface substantially instantaneously as it is applied thereto and so that the velocity of the air being sucked through the slot means is relatively high so as to thereby cause the air, with the entrained fluid, to flow into and through the slot means without substantial condensation of the entrained fluid.

2. The improved cleaning tool described in claim 1 wherein the slot means including first and second slots which have their longitudinal axes disposed substantially parallel to the longitudinal axes of the block assembly, which are positioned substantially midway between the first and second rows of bristles; wherein the first slot extends from adjacent to one of the side edges of the block assembly to adjacent to the transverse axis of the block assembly; and wherein the second slot extends from adjacent to the other of the side edges of the block assembly to adjacent to the transverse axis of the block assembly.

3. The improved cleaning tool described in claim 2 wherein the block assembly includes a chamber which communicates with the first and second slots; wherein the end walls of each of the first and second slots taper inwardly from adjacent to the one surface of the block assembly to adjacent to the chamber so that the distance between the end walls of a slot, adjacent to the chamber, is less than the distance between the end walls of the slot, adjacent to the one surface.

4. The improved cleaning tool described in claim 3 wherein the means for controlling the flow of cleaning fluid is disposed remote from the block assembly; wherein the block assembly is disposed within an enclosure member so that the one surface of the block assembly is the only exposed surface of the block assembly; wherein the enclosure member is mounted on one end of a wand whose length permits the operator of the cleaning tool to stand on the floor while the cleaning tool is utilized to clean a wall or ceiling; wherein the wand includes a portion of the means for connecting the slot means with the means for providing a source of vacuum; and wherein the means for controlling the flow of cleaning fluid is mounted on the other end of the wand.

5. The improved cleaning tool described in claim 4 wherein each of the first and second rows of bristles may be selectively removed from the face of the block assembly so as to permit replacement of worn rows of bristles; wherein the block assembly includes means, in addition to said nozzles, for spraying additional cleaning fluid on the wall or ceiling to be cleaned; and wherein the means for connecting the nozzles with the means for supplying cleaning fluid includes means for alternatively connecting a source of rinse water with the nozzles.

6. The improved cleaning tool described in claim 2 wherein the block assembly is mounted on one end of a wand whose length permits the operator of the cleaning tool to stand on the floor while the cleaning tool is utilized to clean a wall or ceiling; wherein the wand includes a portion of the means for connecting the slot means with the means for supplying a source of vacuum; and wherein the means for controlling the flow of cleaning fluid is mounted on the other end of the wand.

7. The improved cleaning tool described in claim 1 wherein each of the first and second rows of bristles may be selectively removed from the one surface of the block assembly so as to permit replacement of worn rows of bristles; and wherein the block assembly includes means, in addition to said nozzles, for spraying additional cleaning fluid on the wall or ceiling to be cleaned.

8. In a wall and ceiling cleaning tool that includes means for providing a source of vacuum capable of sucking air into the tool and means for supplying cleaning fluid under pressure, an improvement comprising a block assembly which has one surface adapted to be positioned adjacent to the surface of a wall or ceiling to be cleaned and which has a front edge, a rear edge, and side edges, the block assembly being adapted to be moved back and forth across the surface of the wall or ceiling to be cleaned in a direction generally perpendicular to the front and rear edges of the block assembly and including:

(A) a first continuous row of bristles that extend generally along the front edge of the block assembly from one side edge of the block assembly to the other side edge and between the front edge and the longitudinal axis of the block assembly and that has distal ends projecting generally perpendicularly from the one surface of the block assembly toward the surface of the wall or ceiling to be cleaned;

(B) a second continuous row of bristles that extend generally along the rear edge of the block assembly from one side edge of the block assembly to the other side edge and between the rear edge and the longitudinal axis of the block assembly and that has distal ends projecting generally perpendicularly from the one surface of the block assembly toward the surface of the wall or ceiling to be cleaned;

(C) a plurality of spaced nozzles that are disposed adjacent to the first and second rows of bristles and between the first row of bristles and the front ends of the block assembly and between the second row of bristles and the rear edges of the block assembly and that are adapted to be connected with the means for supplying cleaning fluid under pressure so that cleaning fluid will substantially uniformly wet the distal ends of the bristles and so that a thin film of cleaning fluid may be applied to the surface of the wall or ceiling to be cleaned, as the block assembly is moved back and forth across the surface; and (D) first and second slots formed in the block assembly and each having one end communicating with the one surface of the block assembly and each having their other end adapted to communicate with the source of vacuum, the first and second slots having their longitudinal axes disposed substantially parallel to the longitudinal axis of the block assembly and being positioned substantially midway between the first and second rows of bristles, each of the first and second slots having side walls that are generally parallel to each other and to the longitudinal axis of the block assembly and having tapered end walls that extend between the side walls, the first slots extending from adjacent to one of the side edges of the block assembly to adjacent the transverse axis of the block assembly, and the second slots extending from adjacent to the other side edges of the block assembly to adjacent to the transverse axis of the block assembly, the crossectional area of the other ends of the first and second slots being less than the crossectional area of the one ends of the first and second slots so that air sucked into the block assembly causes the extraction of the cleaning fluid from said surface substantially instantaneously as it is applied to said surface and so that the velocity of the air being sucked through the first and second slots is relatively high so as to thereby cause the air, with the entrained fluid, to flow into and through the first and second slots without substantial condensation of the entrained fluid.

9. The improved block assembly described in claim 8 wherein the block assembly includes a chamber which communicates with the other ends of the first and second slots; wherein the end walls of each of the first and second slots taper straight inwardly from adjacent to the one surface of the block assembly to adjacent to the chamber so that the distance between the end walls of a slot, adjacent to the chamber, is less than the distance between the end walls of the slot, adjacent to the one surface.

10. The improved block assembly described in claim 9 wherein the ends of the first and second rows of bristles are disposed adjacent to but spaced from each other at the side edges of the block assembly so that the air may flow into the space between the rows of bristles when the distal ends of the bristles are in contact with the surface of the wall or ceiling to be cleaned.

* * * * *